US007217307B2

(12) United States Patent
Cheng

(10) Patent No.: US 7,217,307 B2
(45) Date of Patent: May 15, 2007

(54) DUST COLLECTOR WITH AN INVERTIBLE WIND EXHAUSTING CASE

(75) Inventor: Chieh-Yuan Cheng, Taichung (TW)

(73) Assignee: San Ford Machinery Co., Ltd., Taichung (TW)

( * ) Notice: Subject to any disclaimer, the term of this patent is extended or adjusted under 35 U.S.C. 154(b) by 349 days.

(21) Appl. No.: 10/900,297

(22) Filed: Jul. 28, 2004

(65) Prior Publication Data

US 2006/0021306 A1 Feb. 2, 2006

(51) Int. Cl.
*B01D 46/00* (2006.01)

(52) U.S. Cl. ..... 55/356; 55/366; 55/429; 55/493; 55/503; 55/505; 55/506; 55/510; 55/DIG. 3; 55/484; 55/378

(58) Field of Classification Search ..... 55/356, 55/366, 429, 493, 503, 505, 506, 510, DIG. 3, 55/484, 378
See application file for complete search history.

(56) References Cited

U.S. PATENT DOCUMENTS 4,917,712 A * 4/1990 Crigler ..... 95/280
5,163,985 A * 11/1992 Chen ..... 55/356
5,169,420 A * 12/1992 Chen ..... 55/315
6,221,135 B1 * 4/2001 Wirth et al. ..... 95/273
2005/0091946 A1 * 5/2005 Cheng ..... 55/356

* cited by examiner

*Primary Examiner*—Minh-Chau T. Pham
(74) *Attorney, Agent, or Firm*—Troxell Law Office, PLLC

(57) ABSTRACT

A dust collector with an invertible wind exhausting case includes a wind exhausting case having an upper and lower cover, which is respectively provided with two threaded holes of the same size in two lateral sidewalls. Two bolts combine tightly the lower cover with each of two upper horizontal tubes of two upper side frames of a platform truck, by screwing the threaded holes. The threaded holes of the upper cover are sealed up with bolts. In case the position of the fan motor and the sucking tube vase is needed to be inverted upside down, it is enough to screw loose the seal bolts of the platform truck and those of the upper cover and then the wind exhausting case can be inverted upside down and then seal bolts are screwed tight again. Thus the inverting work of the invention is much more simplified than a conventional one.

4 Claims, 4 Drawing Sheets

DUST COLLECTOR WITH AN INVERTIBLE WIND EXHAUSTING CASE

BACKGROUND OF THE INVENTION

1. Field of the Invention

This invention relates to a dust collector, particularly to one provided with an invertible wind exhausting case so as to let the position of a fan motor and a sucking tube case fixed respectively on and under the wind exhausting base turned upside down quite easily and quickly.

2. Description of the Prior Art

Conventional medium-sized and large-sized dust collectors 10 shown in FIG. 1 generally includes a wind exhausting case 11, and a platform truck 12 for mounting the wind exhausting case 11 thereon. The wind exhausting case 11 has a fan motor 111 and sucking tube base 112 and plural dust bags 113 on the upper and the lower portion of its two sides. When the fan motor 111 is started to operate, it produces vacuum sucking force in the interior of the wind exhausting case 11 for sucking in dust through the sucking tube base 112 and then the dust is blown and collected in the dust bags 113. Further, the platform truck 12 consists of a platform 121, and four upright tubes 122 positioned at four corners of the platform 121 and having their upper ends respectively fixed firmly with two side walls of the wind exhausting base 11, which is thus mounted securely on the platform 121 of the platform truck 12.

However, the fan motor 111 and the sucking tube base 112 respectively positioned under and on the wind exhausting case 11 often have to be inverted to cope with different sucking conditions. But these two components 111 and 112 are usually fixed tightly with not a few bolts and screws, so it requires quite a lot of time and work to screw loose those bolts and screws for inverting the two components 111 and 112. In addition, after inverting them, the bolts and screws have to be once again screwed tight, causing the inverting process very troublesome. Moreover, in repeating inverting work, improper screwing of the bolts and screws may also give rise to bad effect to dust sucking action.

SUMMARY OF THE INVENTION

This invention has been devised to offer a dust collector with an invertible wind exhausting case, which consists of an upper cover and a lower cover overlapped each other vertically, The upper and the lower cover are provided respectively with a circumferential wall, which is provided with two threaded holes of the same size, so the lower cover are combined threadably with upper horizontal tubes of the two sides of the platform truck with seal bolts, and the threaded holes of the upper cover are screwed with seal bolts.

When a user wants to invert the normal positions of the fan motor and the sucking tube base, the fan motor and the sucking tube base are net necessary to be taken off the wind exhausting case, but the wind exhausting case is possible to be wholly taken off the platform truck together with the fan motor and the sucking tube base and then inverted and fixed in the inverted position with more easiness and fastness than the conventional one. Thus the inverting work of the fan motor and the sucking tube base is simplified in a large extent, upgrading largely handling efficiency, in addition to avoiding improper dust sucking effect of the sucking tube.

BRIEF DESCRIPTION OF DRAWINGS

This invention will be better understood by referring to the accompanying drawings, wherein.

DETAILED DESCRIPTION OF THE PREFERED EMBODIEMNT

Figure 1:
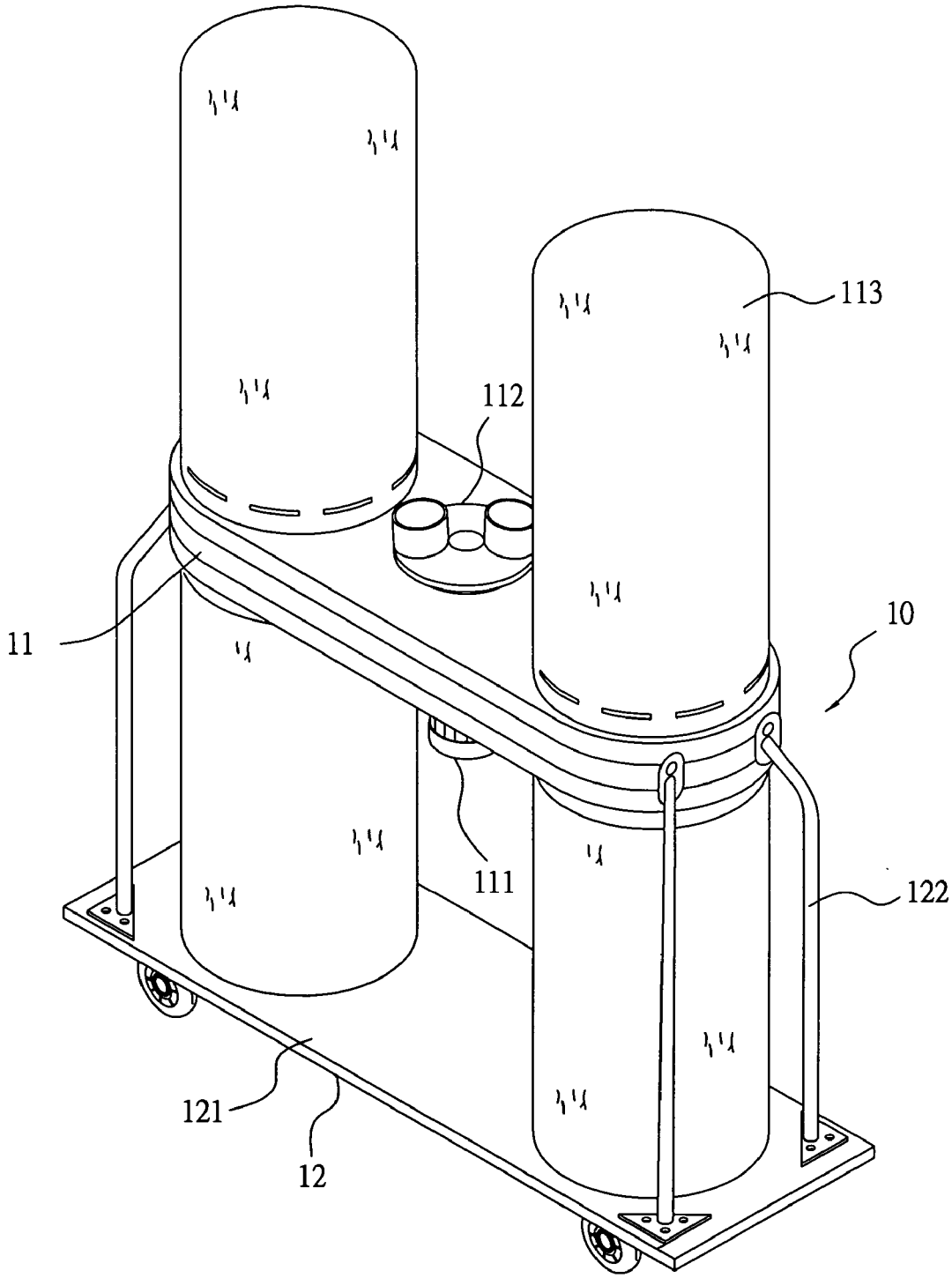
FIG.1 PRIOR ART
FIG. 1 is a perspective view of a conventional dust collector.
Figure 2:
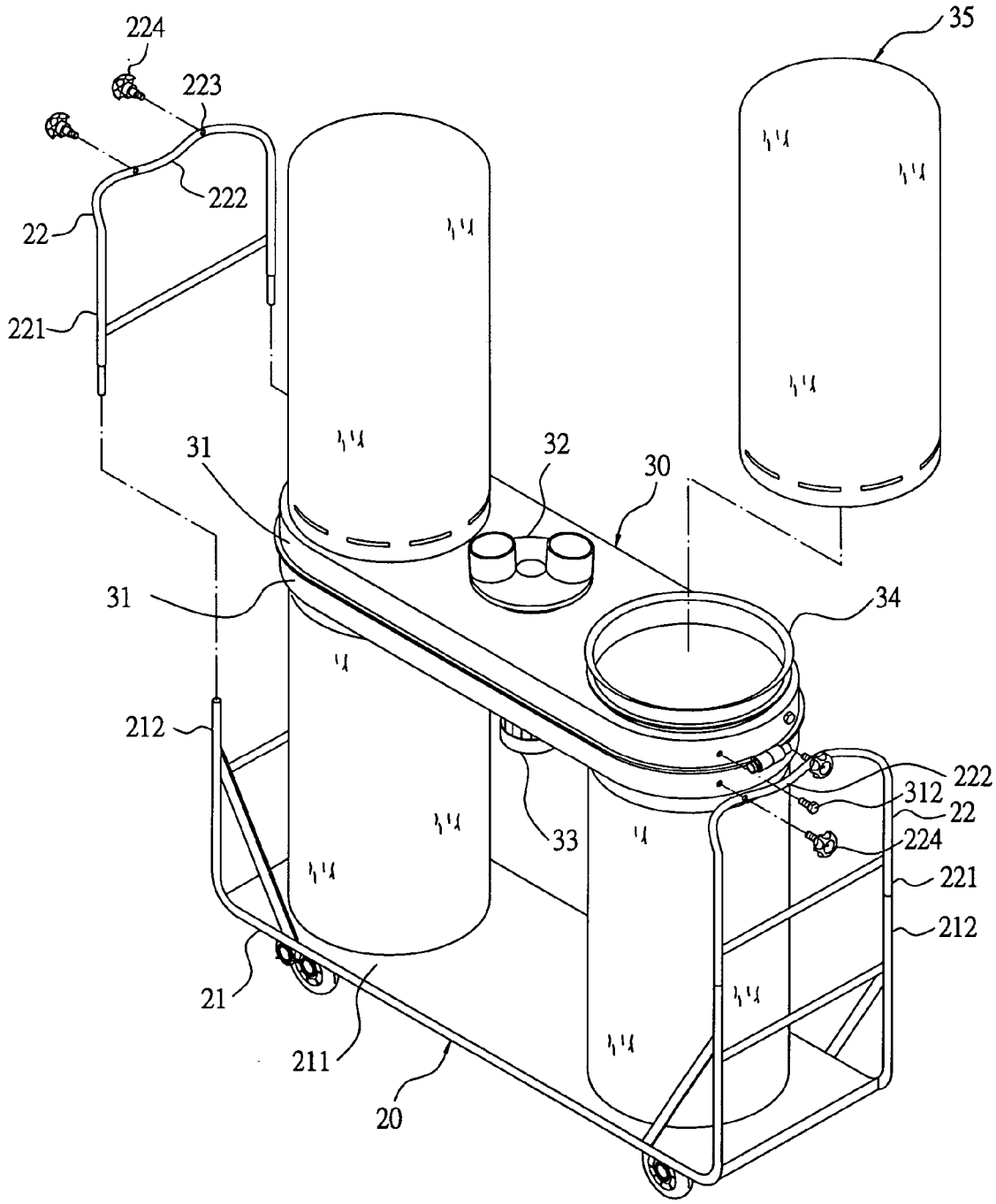
FIG. 2 is a partial exploded perspective view of a dust collector in the present invention.
Figure 3:
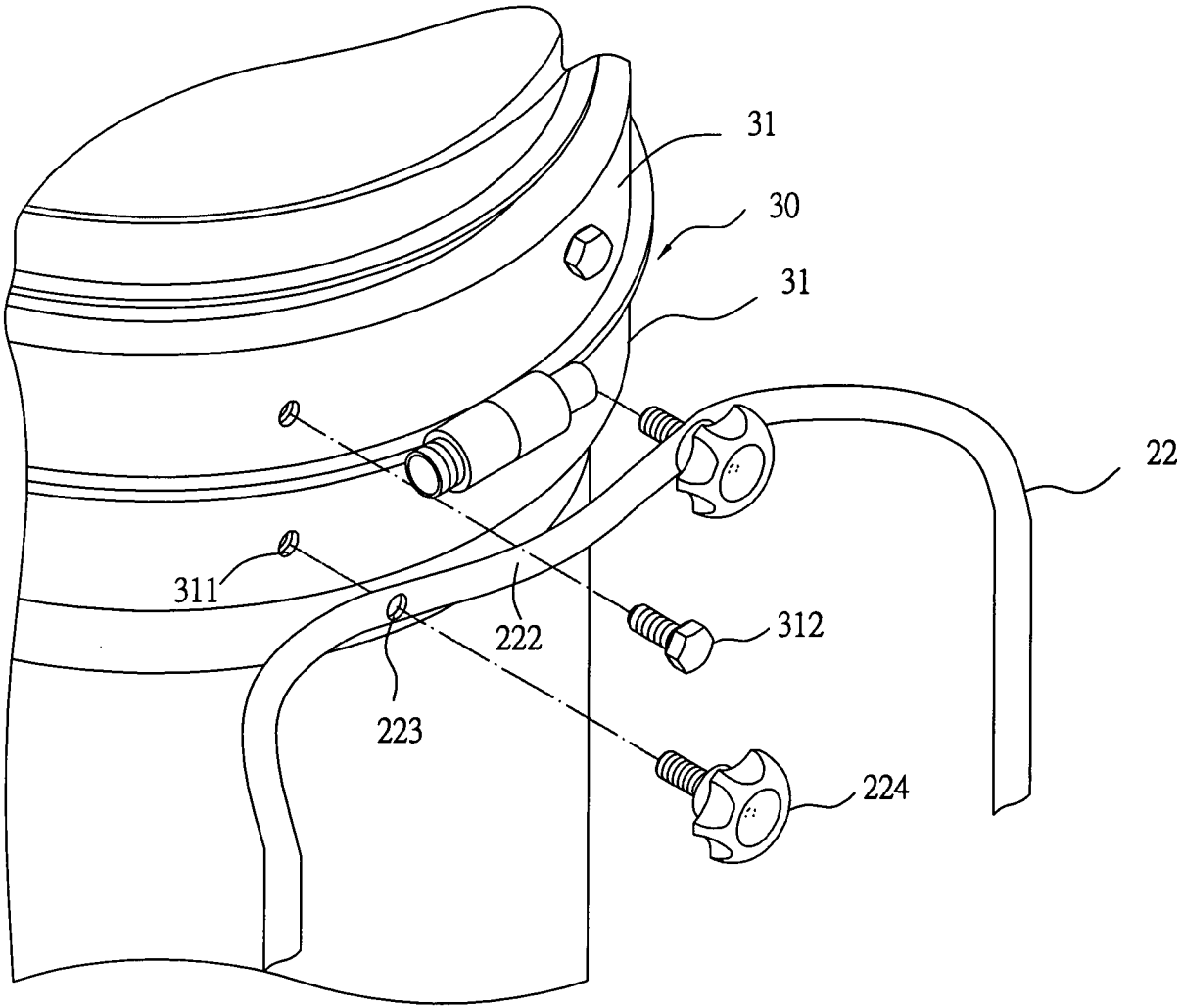
FIG. 3 is an exploded perspective view of a wind exhausting case and the related portion of a platform truck in the present invention; and, FIG. 4 is a side view of the dust collector with the wind exhausting case inverted from the normal position in the present invention.

A preferred embodiment of a dust collector with an invertible wind exhausting case in the present invention, as shown in FIGS. 2 and 3, includes a platform truck 20 and a wind exhausting case 30 and plural dust bags 40.

The platform truck 20 consists of a bottom frame 21, a platform 211 and two side upper frames 22 and four upright tubes 121 extending upright on four corners of the platform 211. The two side upper frames 22 of an inverted U-shape respectively have two side vertical rods 221 to insert in the upright tubes 121 and securing the side upper frames 22 in place. The side upper frames 22 also respectively have a horizontal upper tube 222 between the two side rods 221 and an intermediate curved section.

The wind exhausting case 30 consists of an upper and a lower cover 31 overlapping each other vertically, the upper cover 31 has its upper intermediate surface mounted with the sucking tube base 32, and the lower intermediate surface mounted with the fan motor 33. Further, the upper and the lower cover 31 have two lateral sides of the upper surface respectively fixed with a ring base 34 for attaching a dust bag 35. The two lateral sidewalls of the lower cover just contact and are connected with the curved sections of the two upper horizontal tubes 222.

Further, the upper horizontal tubes 222 of the two side upper frames 22 of the platform truck 20 are respectively provided with two holes 223 spaced apart for seal bolts 224 to screw with.

The upper and the lower covers 31 of the wind exhausting case 30 further have two threaded holes 311 of the same size in two lateral sides, and the two threaded holes 311 of the lower cover 31 are screwed with the seal bolts 224 so as to fix firmly the wind exhausting case 30 with the platform truck 20. The two threaded holes 311 of the upper cover 31 are screwed sealingly by two seal bolts 312.

Figure 4:
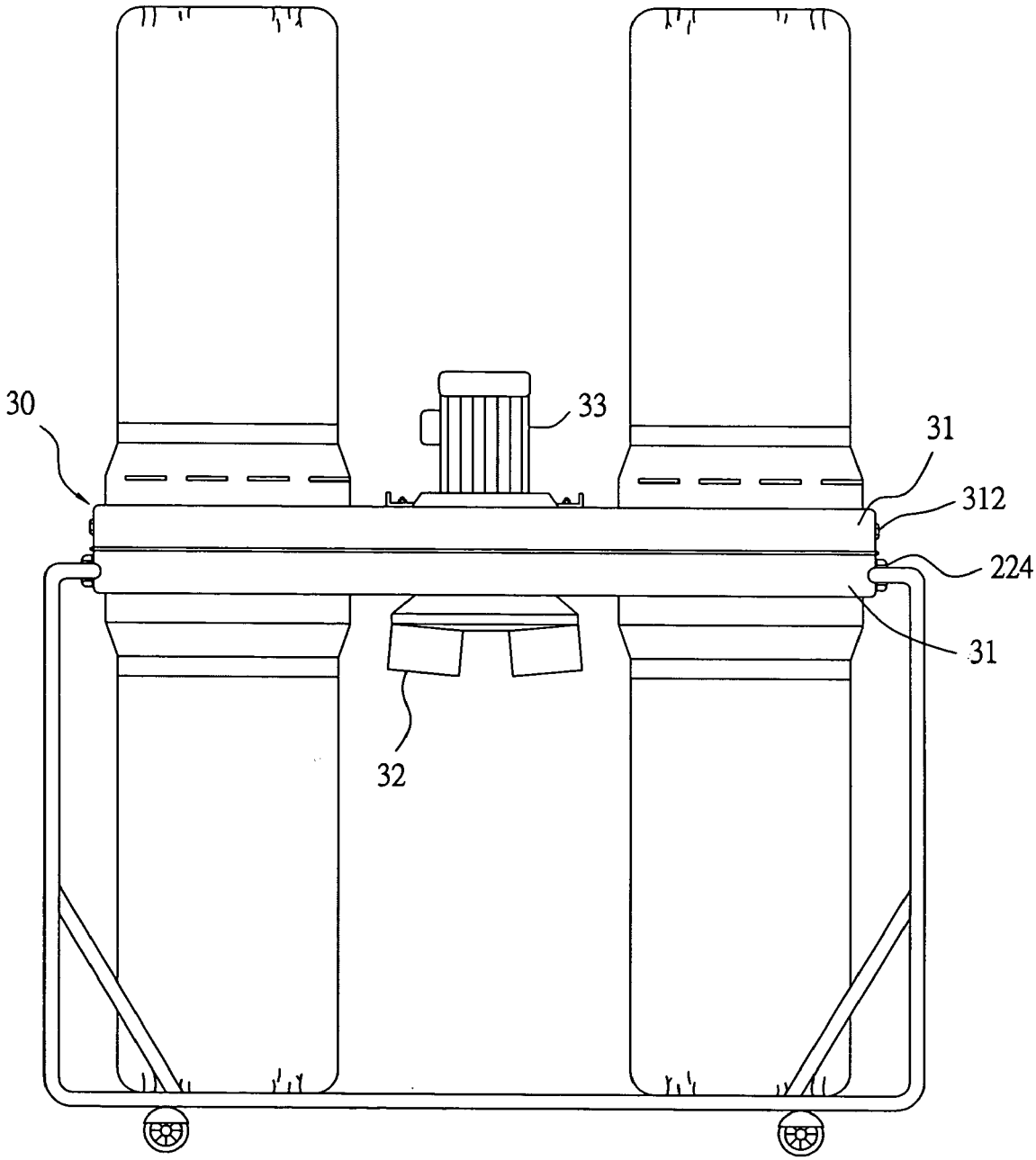

Next, the function of the dust collector is to be described. As shown in FIGS. 3 and 4, in inverting the fan motor 33 and the sucking tube base 32, the seal bolts 224 of the two upper horizontal tubes 222 of the platform truck 20 and the seal bolts 312 of the upper cover 31 are loosened off to permit the wind exhausting case 30 taken off and inverted upside down. Then the seal bolts 224 are made to engage the threaded holes 311 and the holes 223, with the seal bolts 312 screwing with the threaded holes 311 of the upper cover 31, fixing the inverted wind exhausting case 30 with the platform truck 20 once again with easiness and fastness, resulting in inverting of the fan motor 33 and the sucking tube base 32.

Lastly, the dust collector with an invertible wind exhausting case according to the invention has the following advantages.

1. The wind exhausting case 30 can be inverted by screwing loose and tight the bolts 224 and 312, much more convenient to handle than the conventional dust collector.

2. The fan motor 33 and the sucking tube base 32 are not necessary to be taken off and assembled with the wind exhausting case by inverting the wind exhausting case for directly inverting the position of the fan motor 33 and the sucking tube base 32 at the same time, avoiding the potential improper screwing work of the bolts and screws to affect dust collecting function.

While the preferred embodiment of the invention has been described above, it will be recognized and understood that various modifications may be made therein and the appended claims are intended to cover all such modifications that may fall within the spirit and scope of the invention.

What is claimed is:

1. A dust collector with an invertible wind exhausting base comprising a platform truck, a wind exhausting case mounted on a platform of said platform truck, said wind exhausting case having an upper and a lower surface respectively fixed with a fan motor and a sucking tube base thereon, wherein said platform truck is provided with a side upper frame respectively at two sides, each said upper frame having an upper horizontal tube provided with at least two holes for bolts to pass through, wherein said wind exhausting case having two lateral sidewalls respectively provided with at least two threaded holes respectively in an upper portion and in a lower portion in a corresponding way, said two threaded holes in the lower portion screwed with the bolts passing through said holes of said upper horizontal tube of said platform truck so as to secure firmly said wind exhausting case with said platform truck, said threaded holes of the upper portion screwed with sealing bolts to close them up, said wind exhausting base possible to be inverted by screwing loose said bolts so that said sucking tube base may be altered in its position and sucking direction.

2. The dust collector with an invertible wind exhausting case as claimed in claim 1, wherein said platform truck includes a bottom frame, said bottom frame having a platform and four upright tubes positioned upright at four corners of said platform, each said side upper frame being of an inverted U-shape and having two side upright rods, said two side upright rods inserting in said two upright tubes of said bottom frame, said upper horizontal tube having two ends connected with an upper end of said two side upright rods.

3. The dust collector with an invertible wind exhausting case as claimed in claim 1, wherein said wind exhausting case consists of two—one the upper and the other the lower—covers overlapping each other vertically, said upper and said lower cover respectively having an upper surface for fixing a sucking tube base and a fan motor respectively, said threaded holes of said wind exhausting case positioned in two lateral sidewalls of said upper cover and of said lower cover.

4. The dust collector with an invertible wind exhausting case as claimed in claim 1, wherein said upper horizontal tube of said two side frames of said platform truck has an intermediate section curved for contacting with the two lateral sidewalls of said lower cover, said intermediate curved section provided with two holes, said two lateral sidewalls of said lower cover provided with two threaded holes corresponding to said two holes of said intermediate section so that two bolts may engage said holes and said threaded holes for securing said wind exhausting case with said platform truck stably together.

* * * * *